United States Patent [19]

Lafleur

[11] Patent Number: 4,802,319

[45] Date of Patent: Feb. 7, 1989

[54] PANEL STRUCTURE FOR GARAGE DOORS AND THE LIKE

[76] Inventor: Jean-Claude Lafleur, 3409 Maricourt Street-Apt. 6, Sainte-Foy, Canada, G1W 2M4

[21] Appl. No.: 86,606

[22] Filed: Aug. 18, 1987

[51] Int. Cl.[4] ..... E06B 3/70

[52] U.S. Cl. ..... 52/455; 52/475; 52/656; 52/809; 49/501

[58] Field of Search ..... 52/809, 813, 588, 822, 52/398, 400, 403, 731, 732, 242, 772, 475–477, 656, 821, 824, 455; 49/501, DIG. 1, DIG. 2

[56] References Cited

U.S. PATENT DOCUMENTS

| | | | |
|---|---|---|---|
| 3,228,158 | 1/1966 | Russell . | |
| 3,274,741 | 9/1966 | Neagle | 52/242 |
| 3,771,277 | 11/1973 | Rausch et al. . | |
| 3,803,787 | 4/1974 | Daggy . | |
| 4,090,339 | 5/1978 | Anderson . | |
| 4,164,830 | 8/1979 | Bierlich | 52/398 |
| 4,640,078 | 2/1987 | Haffer | 52/731 |

FOREIGN PATENT DOCUMENTS

| | | | |
|---|---|---|---|
| 201842 | 7/1958 | Austria | 52/822 |
| 984736 | 3/1976 | Canada . | |
| 1032724 | 5/1978 | Canada . | |
| 2376927 | 4/1978 | France | 52/772 |

*Primary Examiner*—James L. Ridgill, Jr.

[57] ABSTRACT

Each panel section of a garage door of the articulated type comprises an insulating board of styrofoam, taken in sandwich between two metallic facing sheets, the styrofoam and facing sheets edgewisely carried by a quadrangular tubular frame. The frame is made from extruded tubular sections of plastic, the interior walls thereof being coplanar and flatly edgewisely abutting against the styrofoam boards. A reinforcing metallic frame is mounted within the tubular frame. The tubular frame includes inturned locking flanges at the interior and exterior faces of the panel; at least one locking flange is releasable. The facing sheets and styrofoam boards are held in place by the locking flanges.

9 Claims, 3 Drawing Sheets

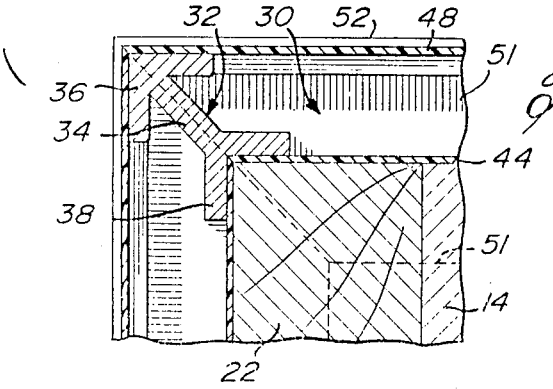
Fig. 4
Fig. 5
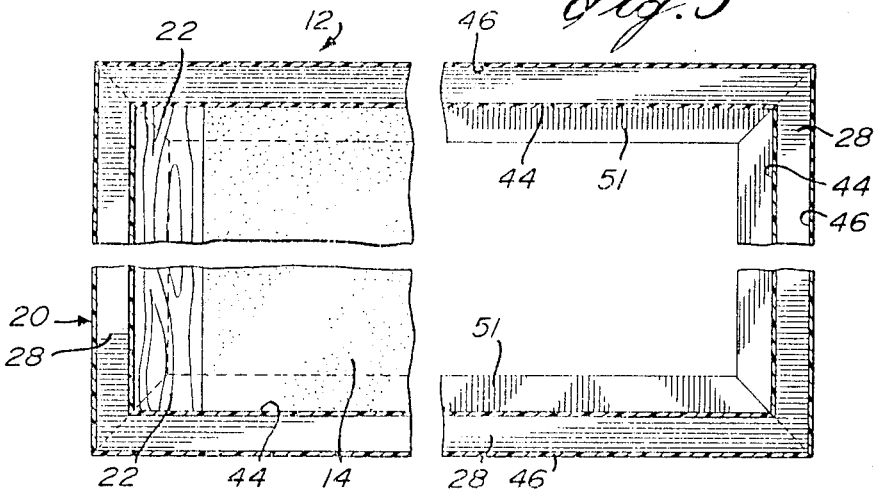

PANEL STRUCTURE FOR GARAGE DOORS AND THE LIKE

FIELD OF THE INVENTION

This invention relates to panels for articulated garage doors used in cold climates, and to similar panels used as patio doors, windows, and the like.

BACKGROUND OF THE INVENTION

In conventional large houses, two-car garages are often used. Such large garages require corresponding large doors, which are usually made of a number of superimposed rectangular wooden panels, hingedly connected in pairs about a common plane. The door is supported and guided by rails, each having a horizontal section anchored to the ceiling of the garage. When the door is closed, all these wooden panels are vertical. When the door is to be opened, it is pulled upwardly along its rails so that the uppermost panel, and subsequently all the other successively lower panels, be pivoted for 90° from a vertical position to a horizontal position, about their interconnecting hinges. Therefore, the panels must be sufficiently strong to avoid bending when in horizontal position.

It can be readily understood that these garage doors need to be thermally insulated during winter in cold climates. Conventional garage door panels are made of metal and are hollow, and are either injected with urethane foam (the best method, although it is expensive) or a rigid styrofoam sheet is inserted into the hollow. The latter method is cheap, but with time and wear, the insulating sheet will shrink, as is well known in the art, whereby cold exterior air will seep through the door panels and the insulation will be ineffective. It has also been found that warping of the panels occurs due to exposure to large temperature differentials. Patio doors and large windows of conventional construction have metallic frames for rigidity but these frames constitute a thermal bridge.

OBJECTS OF THE INVENTION

The prime object of the present invention is to provide a rigid and yet thermally-insulated frame for garage door sections, window panes and the like.

Another object of the invention is to provide a panel, the thermally-insulating properties of which are long-lasting.

A further object of the present invention is to provide an insulated panel which is easily assembled.

Still another object of the present invention is to provide a garage door section which totally eliminates the thermal bridge at the level of its peripheral frame and which does not warp when exposed to a large temperature differential.

SUMMARY OF THE INVENTION

The garage door section of the invention comprises an assembly of a flat, rectangular board member, made of insulating material and of facing sheets taking the board member in sandwich; a peripheral frame surrounding the assembly, the frame including four tubular elements made of resilient, synthetic resin and constant cross-section throughout their length. Each tubular element has 45-degree ends for joining adjacent tubular elements at right angles to each other; each tubular member being of quadrangular cross-section, defining an inner wall abutting an edge face of the board member, an outer wall generally parallel to the inner wall and opposite first and second side walls, first retaining means at said first wall to retain said assembly at one face thereof; inward steps extending from said outer wall and from said inner wall, respectively within said tubular element, substantially parallel to said side walls and arranged in co-planar first and second pairs, the steps of said first pair being closer to said first side wall than the steps of the second pair, at least the steps of the second pair terminating short of each other to leave a first passage therebetween, a side cavity being defined between said inner and outer walls, said first side wall and said first pair of steps, a central cavity being defined by said inner and outer walls and by said first and second pairs of steps; right-angle connector members inserted into said side cavities through said 45-degree ends and uniting said tubular elements two by two; said second side wall made of two longitudinal side wall sections depending from said inner and from said outer walls, respectively and terminating short of each other to leave a second passage therebetween; a unitary rainforcing rectangular metal frame extending within said central cavities of said four tubular members, said inner and outer walls capable of being spread apart to temporarily widen said first and second passages for lateral insertion of said reinforcing frame within said central cavities of said four tubular alements; retainer strips bridging said second passage of each tubular element; complementary connecting means formed on said strip at both of said second wall sections to releasably connect said retainer strips to said second side wall sections, said retainer strips forming second retainer means to retain said assembly at the opposite face thereof. In a preferred embodiment, the facing sheets extend beyond the edge faces of the boardmember and the first and second retainer means are obtained by making the first side wall and the retainer strip of double wall construction and opening at the inner wall to form sleeves receiving and retaining the marginal portions of the facing sheets.

BRIEF DESCRIPTION OF THE DRAWINGS

FIG. 4, on the third sheet of drawings; is a sectional view taken along line 4—4 of FIG. 2;

FIG. 5 is a partly broken and exploded sectional elevational view of a garage door panel taken along line 3—3 of FIG. 2.

DETAILED DESCRIPTION OF THE EMBODIMENTS OF THE INVENTION

Figure 1:
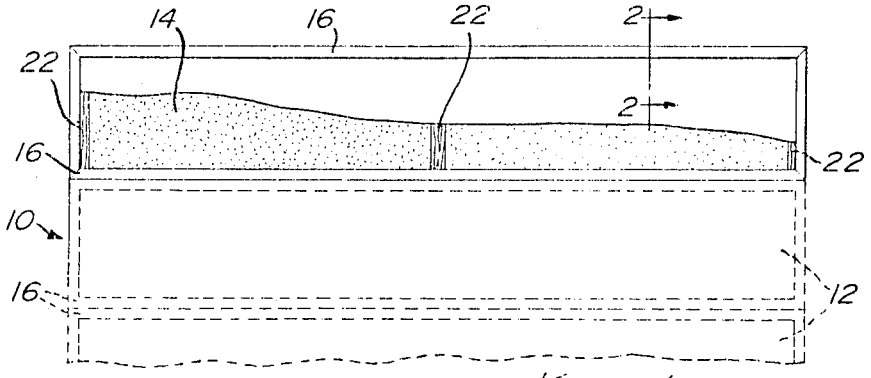
FIG. 1 is a front elevational view of the upper portion of a garage door having superimposed panels hinged in pairs, the topmost door panel being shown in full lines and partly broken, and parts of the lower sections being shown in dotted lines.

The garage door 10 as shown is of the articulated, multiple panel type, i.e. that it is constituted of a number of rectangular panels 12 hingedly interconnected in pair. (The thickness of a standard garage door is 7/4th of an inch) The garage door is supported by rails anchored to the garage ceiling, not shown. When this garage door is closed, all the panels 12 are vertically coplanar, slightly inwardly of the garage door opening and with the bottom panel abutting against the ground while the outer ends of the panels and the top edge portion of the garage door slidingly abut against the edge portions of the garage wall defining the opening for the garage door.

When the garage door is being opened, the uppermost panel 12, and successively the lower ones, are pivoted about 90° to a horizontal position spaced from ground, usually by about 2 meters.

These panels are shown to be insulated with rectangular rigid insulating material boards 14, such as styrofoam and the like. It is important in cold weather that the least possible air be allowed about the longitudinal (top and bottom) horizontal edges 16 of the panels 12.

There is thus further provided accordingly with the first embodiment of the invention a pair of metallic sheets 18, 18', taking in sandwich the insulating batts 14 and held in place by a peripheral frame 20. The insulating batts 14 are not glued or otherwise secured to the metal sheets 18, 18'. Wooden planks or mullions 22 are provided intermediately of each panel 12 and at both ends thereof, each plank serving as anchors for one wing of a double-winged hinge (not shown) which interconnects a pair of mullions 22 of adjacent panels, for relative articulation as is known and need not be further detailed.

Figure 2:
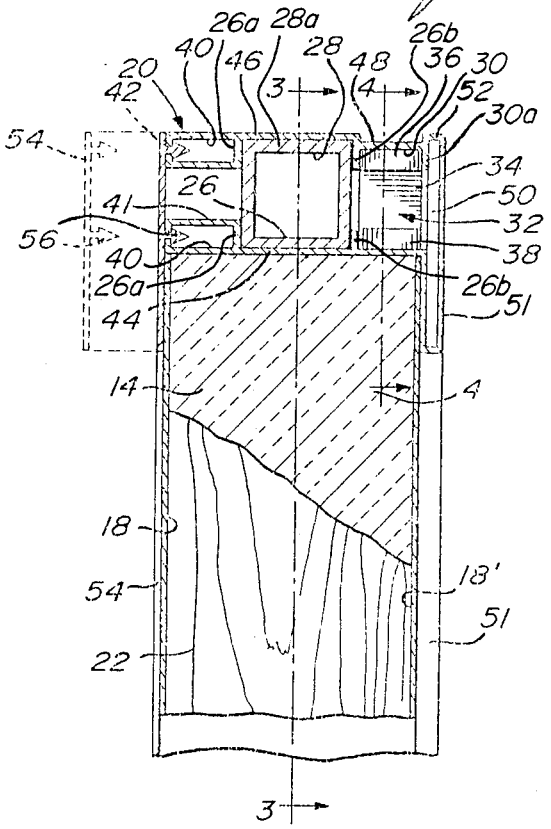
FIG. 2 is an enlarged cross-sectional view taken along line 2—2 of FIG. 1.
Figure 3:
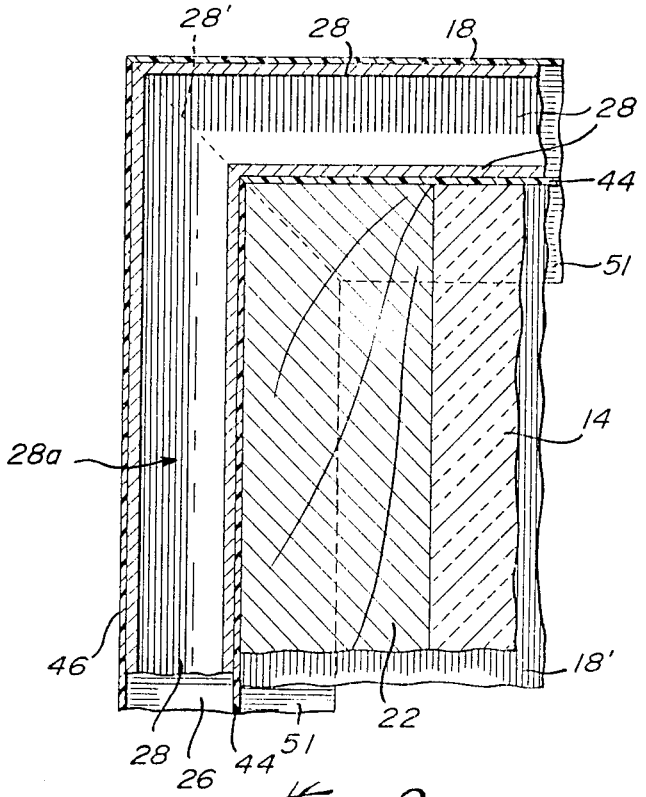
FIG. 3 is a sectional view taken along line 3—3 of FIG. 2.

The frame 20 is made of four extruded sides of heat insulating synthetic resin such as A.B.S. or P.V.C. Each side is resilient and is best seen in cross-sectional view in FIG. 2. It defines four separate sections, each being an open tubular structure of irregular shape forming a partially-opened central square cavity 26 in cross-section, lockingly engaged by a corresponding cross-sectionally square metal tube 28. Metal tube 28 is of sturdy construction, so as to be designed to reinforce the frame structure 20. The ends of each tube 28 are bevelled at 45 degrees of angle, as shown at 28' in FIG. 3, to snugly fit with the bevelled end of the adjacent tube section 28. Four tubes 28 are assembled either by welding or by corner connectors to form a quandrangular reinforcing frame. Cavity 26 opens on the external side of the door into another slightly smaller partly opened side cavity 30.

Corner connectors 32 (made of P.V.C.) are engaged at the ends of this side cavity 30 to interconnect orthogonal pairs of frame member sections, as shown in FIG. 4. The connectors 32 define in cross-section a main shaft 34, an arrow-shaped outer end 36 and an inversely arrow-shaped inner end 38, whereby two frame member sections 20 are then interconnected by press-fit securement to from a complete plastic frame 20A.

Two tubes 40 project from the side of cavity 26 opposite cavity 30. Cavities 40 are similar and spaced from each other by a space or passage 41, which fully opens at the side of frame 20. The outer side wall of each tube 40 defines a slit 42. The interior wall 44 of the frame member 20 defined by the interior walls of interior cavity 40 and of cavities 26 and 30 is flat, wherein this wall 44 is designed to flatly abut against the peripheral edge of insulating panels 14 and the ends of mullions 22. Moreover, the exterior wall 46 defined by cavity 26 is coplanar to that defined by the exterior small cavity 40, said wall 46 slightly exteriorly offset from corresponding wall 48 of cavity 30. Central cavity 26 is defined by walls 44 and 46 and by inwardly-directed side steps **26*a* and 26*b*. Side cavity 30 is defined by walls 44, 46, by steps 26*b* and by an inward step 30*a***.

Cavity 30 itself opens into a further cavity 50, on the side opposite cavity 26. Cavity 50 is very thin but is about twice as transversely elongated as cavity 30, so as to define a hollow flange 51 extending along the exterior main face of exterior metal sheet 18'. The small end wall 52 defined by cavity 50 opposite flange 51 is coplanar to wall 46.

It should be noted that the passage 41 between the walls of the two tubes 40 opens to the exterior so that the walls 44, 46, can be spread apart to laterally insert the pre-assembled metallic reinforcing frame **28*a* through the widened passage 41 and snap frame 28 into central cavity 26 between steps 26*a*, 26*b*. The sides of plastic frame 20 are first pre-assembled by means of the corner connectors 32. The assembled reinforcing frame 28 is then laterally inserted into cavity 26. Then, exterior sheet 18', board 14, mullions 22, and internal sheet 18 are inserted within the volume defined by the quandrangular frame member 20 with outer sheet 18' abutting against flange 51**.

Finally, assembling of a panel 12 is completed by securing a locking strip 54 into the slits 42 of tubes 40. Strip 54 is of a shape similar to flange 51 but is full and thinner, and includes a pair of cross-sectionally arrow-shaped ribs 56 designed to releasably lockingly engage into tubes 40 through their slits 42, whereby strip 54 bridges passage 41.

Figure 6:
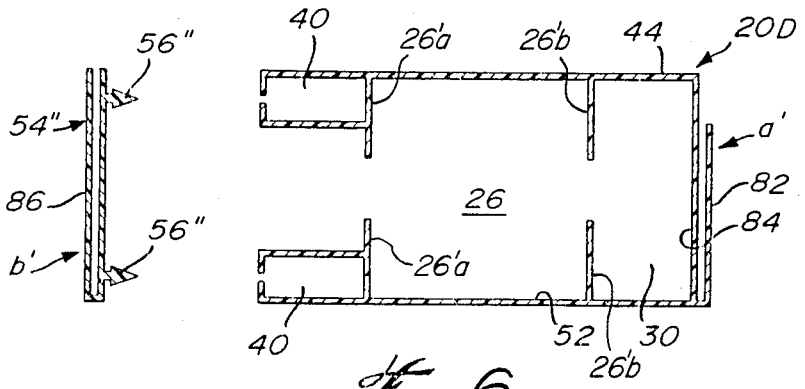
FIG. 6, on the second sheet of drawings, is an enlarged cross-sectional view of a section of garage door according to a second embodiment of the invention.

The embodiment of FIG. 6 was devised because with the prior embodiment, rainwater and condensate water may eventually seep between the exterior and interior metal sheet 18 and 18', respectively, and the exterior frame member flange 51, and locking flange 54, into the insulating material 14 and wood mullions 22 to deteriorate same with time.

In view thereof, there is introduced inwardly-opening sleeve 82 in lieu of flange 51, so that the exterior metal sheet which will then be of greater size than the insulating board 14, can slidingly engage into the sleeve 82. Sleeve 82 outwardly depends from a flat side wall 84 of the frame member 20D, wall 84 joining end wall 52 to flat wall 44. The locking strip 54'' is similarly of double-wall construction, with an inwardly opening sleeve 86 engageable by the edge portion of the interior metal sheet 18, strips 54'' having arrow-shaped ribs 56'' lockingly engageable through slits 42 into corresponding tubes; 40 as in the first embodiment of the invention. Frame member 20D has inward steps **26'*a*, 26'*b* corresponding to steps 26*a* and 26*b* and serving to partly surround reinforcing frame 28*a*. Any water collected in sleeves 82, 86, will overflow therefrom, and fall to the ground instead of within the panel. Otherwise, the features of this latter embodiment remain the same as in the previous embodiments. Central cavity 26 receives the metallic reinforcing frame 28 while cavity 30 receives the corner connectors 32**.

In the two embodiments, the plastic frame 20, or 20D with its cavities serves as a thermal barrier despite the presence of the metallic reinforcing frame. The panel section will not warp because facing sheets 18, 18', insulating boards 14 and mullions 22 can shrink or expand in accordance with their respective coefficients of thermal expansion, since they are not fixed to each other or to the surrounding frames.

Also, note that the embodiment of frame member shown in FIG. 7 could be used to carry a structure other than a garage door panel section, for instance a glass panel to form a window or a patio door.

I claim:

1. A panel comprising a main panel member edgewisely carried by a quadrangular frame member, said frame member made from extruded tubular sections each having bevelled ends, one central cavity and at least two opposite first and second side cavities, the interior walls of said cavities of each tubular section being coplanar and flatly edgewisely abutting against said main panel member; wherein in each tubular section, a reinforcing tube is engaged in said central cavity and has bevelled ends, means interlocking the bevelled ends of said reinforcing tubes in pairs, corner connectors mounted in said first side cavities interlocking said tubular sections in pairs; and retaining means retaining said main panel member within said frame member.

2. A panel as defined in claim 1, wherein said retaining means includes a first flange member, mounted to said tubular sections exteriorly of said one side cavity and projecting inwardly beyond said tubular sections interior wall, and a second flange member, releasably engageable into said tubular sections exteriorly of said second side cavity so as to project inwardly beyond said interior wall; said flange members holding in place said main panel member within the volume defined by said frame member.

3. A panel as in claim 2, wherein said first flange member is integral with said tubular section.

4. A garage door section comprising an assembly of a flat, rectangular board member, made of insulating material and of facing sheets taking said board member in sandwich; a peripheral frame surrounding said assembly including four tubular elements made of resilient and synthetic resin and constant cross-section throughout their length, each tubular element having 45-degree ends for joining adjacent tubular elements at right angles to each other, each tubular element of rectangular cross-section defining an inner wall abutting an edge face of said board member, and outer wall generally parallel to said inner wall, and opposite first and second side walls; first retainer means at said first side wall to retain said assembly at one face thereof; inward steps extending from said outer wall and from said inner wall respectively, within said element, substantially parallel to said side walls and arranged in co-planar first and second pairs, the steps of the first pair being closer to said first side wall than the steps of said second pair, at least the steps of said second pair terminating short of each other to leave a first passage therebetween, a side cavity being defined between said inner and outer walls, said first side wall and said first pair of steps, a central cavity being defined by said inner and outer walls and by said first and second pairs of steps; right-angle corner connector members inserted into said side cavities through said 45-degree ends and uniting said tubular elements two by two; said second side walls made of two longitudinal side wall sections depending from said inner end outer walls and terminating short of each other to leave a second passage therebetween; a reinforcing unitary rectangular metal frame extending within said central cavities of said four tubular elements; said inner and outer walls capable of being spread apart to temporarily widen said first and said second passages for lateral insertion of said reinforcing frame within said central cavities of said four tubular elements; retainer strips bridging said second passage of each tubular element; complementary connecting means formed on said strip and at both of said second side wall sections releasably connect said strip to said second side wall sections; said retainer strips forming second retainer means to retain said assembly at the opposite face thereof.

5. A garage door section as defined in claim 4, wherein said facing sheets extend beyond the edge faces of said board member; and wherein said first and second retainer means comprise said first end wall and said retainer strip being of double-wall construction, opening at said inner wall to form sleeves receiving and retaining the marginal portions of said facing sheets.

6. A garage door section as defined in claim 4, further including a pair of integral interiorly-projecting tubes depending from said inner and said outer walls and forming said secind pair of steps and said second side wall sections, said tubes facing and extending short of each other and forming said first and second passages therebetween, and said complementary connecting means including a slit longitudinally extending in each of said second side wall sections, and a pair of spaced parallel arrow-shaped ribs inwardly projecting from said strip and longitudinally extending therealong, said ribs snappingly engaging into said slits.

7. A garage door section as defined in claim 4, further including spaced wooden planks located in said board member to serve as anchors for hinges adapted to interconnect said garage door section to an adjacent similar garage door section.

8. A garage door section as defined in claim 4, wherein said facing sheets are co-extensive with said board member and wherein said first and second retainer means are formed by said first side wall and by said strip, respectively, inwardly projecting from said inner wall.

9. A garage door section as defined in claim 8, wherein said first side wall is of double-wall construction forming a close chamber for increased thermal insulation.

* * * * *